United States Patent [19]

Compton

[11] Patent Number: 4,566,733

[45] Date of Patent: Jan. 28, 1986

[54] CHAIR FOR WORK ENVIRONMENT

[76] Inventor: Arthur M. Compton, Grand Rapids YMCA, 33 Library St., Grand Rapids, Mich. 49503

[21] Appl. No.: 555,815

[22] Filed: Nov. 28, 1983

[51] Int. Cl.[4] ..... A47C 3/00; A47C 7/14

[52] U.S. Cl. ..... 297/284; 297/458

[58] Field of Search ..... 297/284, 460, 458, 459; 5/446, 447

[56] References Cited

U.S. PATENT DOCUMENTS

| | | | |
|---|---|---|---|
| 465,275 | 12/1891 | Kennedy et al. | 297/284 |
| 2,049,550 | 8/1936 | Van Dresser et al. | 297/284 |
| 3,642,319 | 2/1972 | Berchicci | 297/284 |
| 3,762,769 | 10/1973 | Poschl | 297/284 |
| 3,990,742 | 11/1976 | Glass et al. | 297/284 |
| 4,040,661 | 8/1977 | Hogan et al. | 297/284 |

FOREIGN PATENT DOCUMENTS

| | | | |
|---|---|---|---|
| 2820917 | 11/1979 | Fed. Rep. of Germany | 297/284 |

*Primary Examiner*—William E. Lyddane
*Assistant Examiner*—Mark W. Binder

[57] ABSTRACT

A chair seat construction which includes a flexible seat plate, and a U-shaped structural member extending fore and aft of the seat plate. A pair of hinges is provided, with each hinge pivotally joining the longitudinal upper edge of one leg of the U-shaped structural member to the seat plate. A cam is operatively connected between the seat plate and the U-shaped structural member for flexing the seat plate and varying its contour, and an actuating member is operatively connected to the cam for actuation thereof.

5 Claims, 8 Drawing Figures

CHAIR FOR WORK ENVIRONMENT

This invention relates to improvements in chair design, and refers more particularly to chairs used in a work enviroment, where workers are required to remain seated for long periods.

Chairs with seats that are contoured to fit with the body, and which tilt by rotation about a transverse axis are well known to the art. However, such seats are deficient in that the pressure points between the seat surface and the thighs and buttocks of the occupant are constant, resulting in progressively deteriorating circulating in those areas. This can result in ischemia, which in turn can result in aches, pains, and numbness, all of which tend to distract the occupant, and thereby to reduce his productivity.

The instant invention comprises a chair seat which can not only tilt by rotation about a transverse axis, a feature common to many chairs, but can also change its shape or contour in order to change the pressure points on the occupant's thigh and buttocks from time to time with the objective of reducing his discomfort and fatigue and improving his productivity.

An object of this invention is to provide a chair set design which offers all the advantages of other chairs plus a periodic change in seat contour that will provide the occupant with greater comfort, and which will lessen fatigue by improving circulation.

Another object of the invention is to provide a chair seat of varying contour, whose contour changes automatically whenever the chair is rocked back by the occupant to the full back tilt position.

Another object of the invention is to provide a chair that is less likely to overturn rearward when the occupant leans back. It is generally recognized that most personal injury accidents in offices are the result of chair overturn, and that most overturns are the result of the occupant leaning backwards, causing the chair to become unstable due to movement of the center of gravity too far rearward. The instant invention causes the center of gravity of the occupied chair to remain stationary in the fore and aft sense, or even to move forward, thus eliminating the cause of rear overturn caused by the occupant leaning backwards.

Other and further objects of the invention will appear in the course of the following description thereof.

In the drawings, which form a part of this specification and are to be read in conjunction therewith, an embodiment of the invention is shown, and, in the various views, like numerals are employed to indicate like parts.

Figure 2:
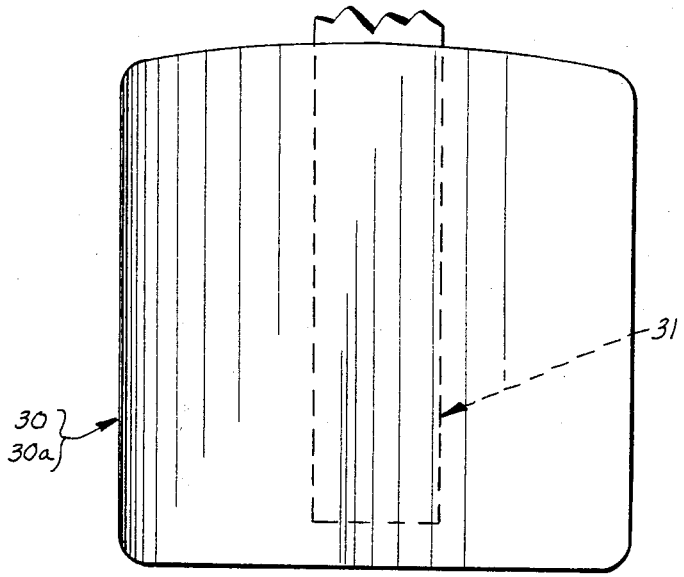
FIG. 2 is a top view of FIG. 1, showing only the relationship between the seat plate 30 and channel 31.
Figure 3:
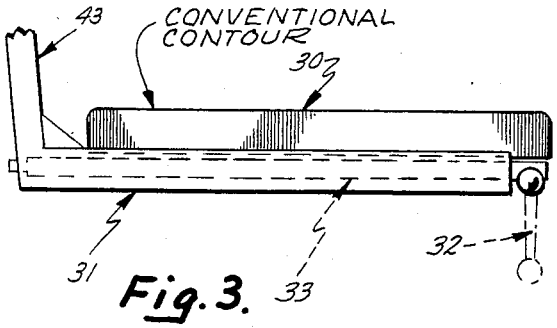
FIG. 3 is a left side view of FIG. 1.
Figure 1:
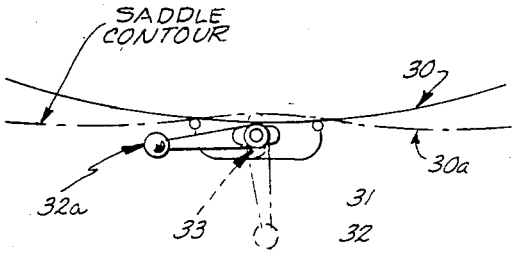
FIG. 1 is a front view of the seat and related structure and mechanism.

Referring to the drawings, and beginning with FIGS. 1,2,3, and 4, at 30 is a seat plate of a flexible material such as Inland Steel Co. "MarTINsite" steel or fiberglass, which is formed into a very flat trough shape, concave upward. The same plate, now designated 30*a*, assumes a "saddle", or very flat "W" shape, after having been forced up in the middle by cam 33 or cam 34, which latter will be found in FIGS. 5 and 6.

Figure 4:
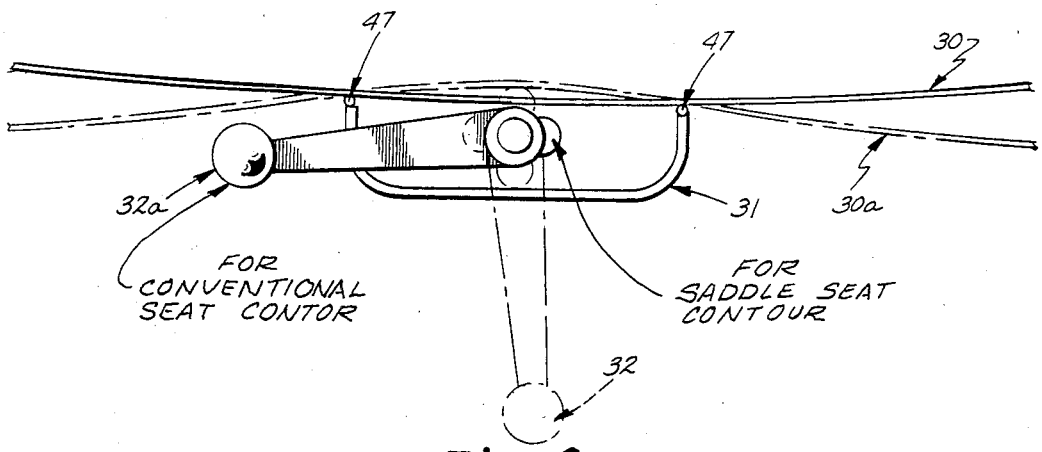
FIG. 4 is FIG. 1 enlarged for clarity.

Channel 31, which is made of thicker material than seat plate 30, and is therefore much stiffer, underlies 30, and is pivotally attached thereto throughout its length by hinges 47 (FIG. 4).

At its rear end (the left end in FIG. 3), 31 is attached to approximately vertical member 43, which forms the back structure of the chair, and whose function will be discussed in connection with FIGS. 5 and 6.

Cam 33 is an elongated member running from front to rear, and pivotally supported in the front and rear transverse end plates (not shown) of channel 31. Cam 33 is fixedly attached to handle 32, and is rotated approximately 90° around its longitudinal axis as handle 32 is moved to position 32*a*. It will be seen that cam 33, when rotated by handle 32 so that its long cross sectional axis is vertical, forces seat plate 30 to bow upward in the middle, thus assuming the 30*a*, or "saddle" contour.

Turning now to FIG. 5,6,7, and 8, FIG. 5 shows a cross member 41 supported rotatably on vertical cylindrical spindle 42 which, at its lower end (not shown) is attached to the base of the chair. At either end of cross member 41, which is slightly longer than the seat is wide, is attached a strut 45, which extends upwardly and forwardly to include transverse pivot point 46. Attached rotatably to pivot point 46 are a pair of arms 44 which extend rearwardly, and are rigidly attached to back structure 43.

Thus the entire seat, back, and arm structure, including 30,31,37,43, 44, and either cam mechanism 32 or cam mechanism 34 and latch 48, rotate as a unit about point 46 whenever the occupant leans back in the chair.

It should be noted that a pair of coiled torsion springs are located surrounding point 46 for the purpose of holding the seat approximately horizontal during normal usage. However, such springs are not a part of this invention.

Figure 5:
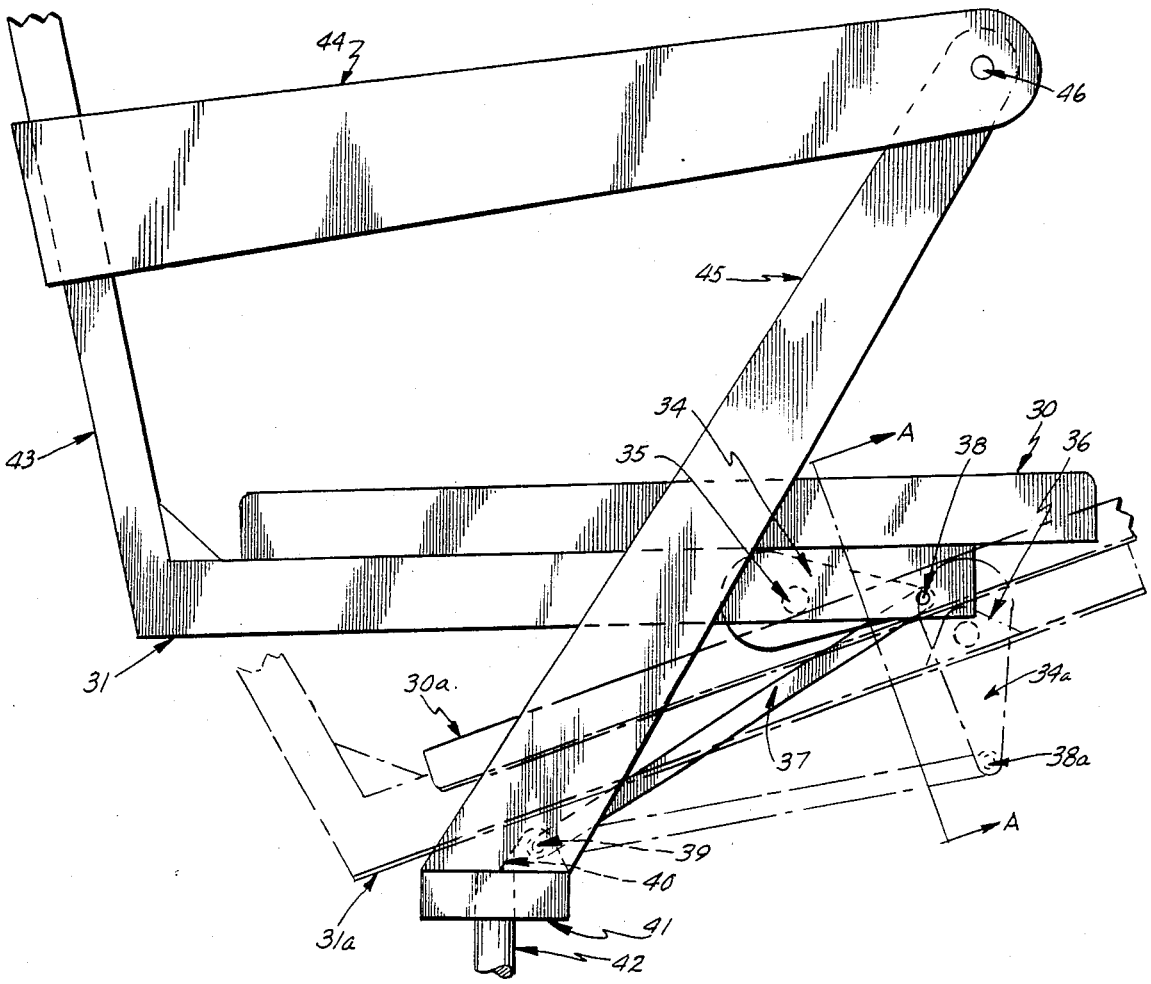
FIG. 5 is a view similar to FIG. 3, but enlarged in scale and scope to show "tilting" action, or rotation of the seat about a transverse axis.

Referring specifically to FIG. 5, a cam 34 of flat steel, pear shaped in profile, is shown rotatably attached to 31 by means of pin 35 and ears 36. The small end of the cam is rotatably attached to link 37 by means of pin 38. The lower end of link 37 is rotatably attached to cross member 41 by means of ears 40 and pin 39.

When the seat is approximately horizontal, cam 34 is also approximately horizontal, and is only lightly, if at all, in contact with seat plate 30. However, when the seat assembly rotates counter-clockwise about point 46, so that seat plate 30 moves to position 30*a*, link 37, rotating about pin 39, moves to position 37*a*, drawing cam 34 into position 34*a* by means of pin 38, which is now at position 38*a*.

Figure 6:
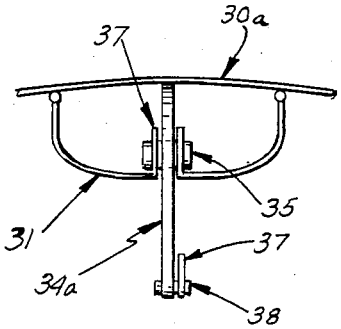
FIG. 6 is a partial sectional view of FIG. 5 along line "A—A".

Referring to FIG. 6, an end view of FIG. 5, we see the cam in the 34*a*, or nearly vertical position. In that position, the broad, rounded end of the cam has thrust the center portion of the seat plate 30 upward into position 30*a*, and so has transformed the seat into the saddle contour.

Figure 7:
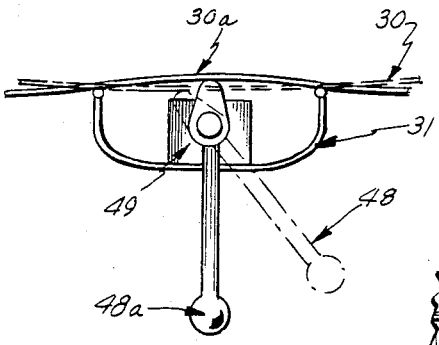
FIG. 7 is a view similar to FIG. 6, but taken from the other (front) end of FIG. 5 reclined, and showing the mechanism that serves to hold the seat plate 30 in the "saddle" position.
Figure 8:
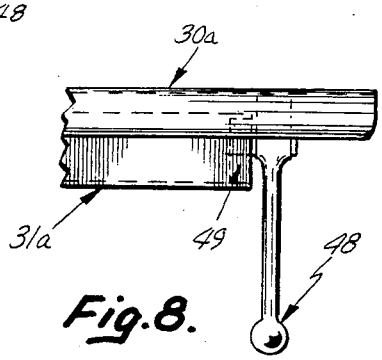
FIG. 8 is a left side view of FIG. 7.

Referring to FIGS. 7 and 8, latch lever 48, which has now replaced handle 32 (FIGS. 1 and 3), and which is rotatably mounted in 31 by means of plate 49, rests in position 48 while seat plate 30 is in the trough contour.

When cam 34*a* (FIGS. 5 and 6), thrusts the center of the seat plate up into the saddle contour, the latch lever drops by gravity into position 48*a*, thereby locking the seat plate into the 30*a*, or saddle, contour.

Whenever the occupant desired to return the seat plate to the trough contour, he manually moves 48*a* to the 48 position, whereupon the seat plate, having been originally formed concave upward, springs back to 30, the trough contour.

Having thus described my invention, I claim:

1. A chair seat construction comprising: a flexible seat plate, U-shaped structural member extending fore and aft of the seat plate, a pair of hinges, each hinge pivotally joining the longitudinal upper edge of one leg of the U-shaped structural member to the seat plate, a cam means operatively interconnected between the seat plate and the U-shaped structural member for flexing the seat plate and varying its contour, and an actuation means located mainly outside the U-shaped structural member and operatively connected to said cam means so that said cam means may be actuated to flex the seat plate and thereby change its contour.

2. The chair seat construction as in claim 1 wherein said actuation means includes a handle, whereby an occupant of the chair may cause the seat plate to flex and change its contour by moving the handle.

3. The chair seat construction as in claim 1, including means for tiltably, mounting said seat plate on a support member and wherein said actuation means is operatively connected to said means for tiltably mounting said seat plate, whereby tilting of said seat plate about its tilt axis causes said seat plate to flex and change its contour.

4. The chair seat construction as in claim 3 in which the shape or contour of the seat plate, as seen from the front, varies from a shallow trough shape to a shape resembling an extremely flat "W", with a ridge in the middle and slightly turned up at the edges, as the seat plate is tilted rearwardly.

5. The chair seat construction as in claim 1 wherein the seat plate is tiltably mounted on a support member about a transverse axis, and wherein the transverse axis is located above the level of the seat plate and forward of the center of gravity of an occupant.

* * * * *